US011724521B2

(12) United States Patent
Hosono

(10) Patent No.: US 11,724,521 B2
(45) Date of Patent: Aug. 15, 2023

(54) INK HEATING DEVICE AND PRINTING APPARATUS

(71) Applicant: Konica Minolta, Inc., Tokyo (JP)

(72) Inventor: Yutaka Hosono, Kanagawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 17/728,108

(22) Filed: Apr. 25, 2022

(65) Prior Publication Data

US 2022/0348030 A1 Nov. 3, 2022

(30) Foreign Application Priority Data

Apr. 28, 2021 (JP) ..... 2021-075557

(51) Int. Cl.
*B41J 11/00* (2006.01)

(52) U.S. Cl.
CPC ..... *B41J 11/00212* (2021.01)

(58) Field of Classification Search
CPC ..... B41J 11/00212; B41J 2202/08; B41J 2202/20; B41J 2202/21; B41J 2/195; B41J 2/17553
See application file for complete search history.

(56) References Cited

U.S. PATENT DOCUMENTS

2022/0314670 A1* 10/2022 Torikai ..... B41J 2/17513

FOREIGN PATENT DOCUMENTS

JP 2016-078240 5/2016

* cited by examiner

*Primary Examiner* — Bradley W Thies
(74) *Attorney, Agent, or Firm* — BakerHostetler

(57) ABSTRACT

An ink heating device, which is incorporated in an inkjet printing apparatus, includes: a planar heating member bonded in a state where one surface of the planar heating member is thermally bonded to an outer surface of an ink tank storing ink; an elastic member, having a heat insulation property, is provided on the other surface of the planar heating member and presses the planar heating member against the ink tank; and a hardware processor that performs heating control on the planar heating member in a stepwise manner according to a stop time of a main body of the printing apparatus at a time of starting the main body of the printing apparatus.

11 Claims, 12 Drawing Sheets

FIG. 10

43

| DATE AND TIME | LOG INFORMATION |
|---|---|
| 2021/03/26 08:01 | POWER SUPPLY ON |
| 2021/03/26 19:31 | POWER SUPPLY OFF |
| 2021/03/29 07:15 | POWER SUPPLY ON |
| ⋮ | ⋮ |
| 2021/04/07 07:36 | POWER SUPPLY ON |

FIG. 11

44

| APPARATUS STOP TIME [DAY] | NUMBER OF HEATING STAGES | FIRST-STAGE HEATING | | SECOND-STAGE HEATING | | THIRD-STAGE HEATING | | FOURTH-STAGE HEATING | |
|---|---|---|---|---|---|---|---|---|---|
| | | TARGET TEMPERATURE [°C] | MAINTAINING TIME [SECOND] | TARGET TEMPERATURE [°C] | MAINTAINING TIME [SECOND] | TARGET TEMPERATURE [°C] | MAINTAINING TIME [SECOND] | TARGET TEMPERATURE [°C] | MAINTAINING TIME [SECOND] |
| 0 | 0 | – | – | – | – | – | – | – | – |
| 1 TO 2 | 2 | 35 | 10 | 50 | 10 | – | – | – | – |
| 3 TO 10 | 3 | 30 | 10 | 40 | 10 | 50 | 10 | – | – |
| 11 TO 20 | 3 | 30 | 20 | 40 | 20 | 50 | 20 | – | – |
| 21 OR MORE | 4 | 30 | 30 | 40 | 20 | 45 | 20 | 50 | 10 |

INK HEATING DEVICE AND PRINTING APPARATUS

CROSS-REFERENCE TO RELATED APPLICATIONS

The disclosure of Japanese patent application no. 2021-075557, which was filed on Apr. 28, 2021, is incorporated herein by reference in its entirety.

BACKGROUND

Technological Field

The present disclosure relates to an ink heating device and a printing apparatus.

Description of the Related art

In the related art, there has been known an inkjet printing apparatus that includes an inkjet head that ejects ink from a nozzle, and forms an image on a recording medium by ejecting the ink from the inkjet head toward the recording medium and making the ink land on the recording medium.

The ink used in the inkjet printing apparatus is changed in viscosity by heating. In order to smoothly send the ink from an ink tank to the inkjet head and stably eject the ink from the inkjet head, it is necessary to heat the ink before ejection in advance and maintain a temperature of the ink in an appropriate temperature range.

Therefore, in a configuration in which a planar heating member is provided on an outer surface of the ink tank that supplies the ink to the inkjet head and the ink in the ink tank is heated by the heating member, there is a technique of enhancing heating efficiency by providing an elastic member having a heat insulating effect on a non-heating surface side of the heating member, and pressing the heating member against the ink tank with a restoring force of elastic deformation of the elastic member (refer to, for example, JP 2016-78240 A).

Deterioration of the elastic member may progress depending on conditions such as temperature and humidity, and there is a possibility that the effect of enhancing the heating efficiency of the ink is lost as the deterioration progresses. That is, when the deterioration progresses and the elastic force of the elastic member is lost, the force pressing the heating member against the ink tank is weakened, a gap (air layer) is formed between the heating member and the ink tank, the air layer becomes a heat insulating layer, and thus heat may not be easily transferred to the ink tank.

SUMMARY

The present disclosure has been made in view of the above problems, and an object of the present disclosure is to provide an ink heating device capable of suppressing the progress of deterioration of an elastic member, and a printing apparatus including the ink heating device.

To achieve the abovementioned object, according to an aspect of the present disclosure, there is provided an ink heating device incorporated in an inkjet printing apparatus, and the ink heating device reflecting one aspect of the present disclosure comprises: a planar heating member that is bonded in a state where one surface of the planar heating member is thermally bonded to an outer surface of an ink tank storing ink; an elastic member that has a heat insulation property, is provided on the other surface of the planar heating member, and presses the planar heating member against the ink tank; and a hardware processor that performs heating control on the planar heating member in a stepwise manner according to a stop time of a main body of the printing apparatus at a time of starting the main body of the printing apparatus.

BRIEF DESCRIPTION OF THE DRAWINGS

The advantages and features provided by one or more embodiments of the disclosure will become more fully understood from the detailed description given hereinbelow and the appended drawings which are given by way of illustration only, and thus are not intended as a definition of the limits of the present disclosure:

FIG. 10 is a diagram illustrating an example of start log information;

FIG. 11 is a diagram illustrating an example of temperature increase control information;

DETAILED DESCRIPTION

Figure 1:
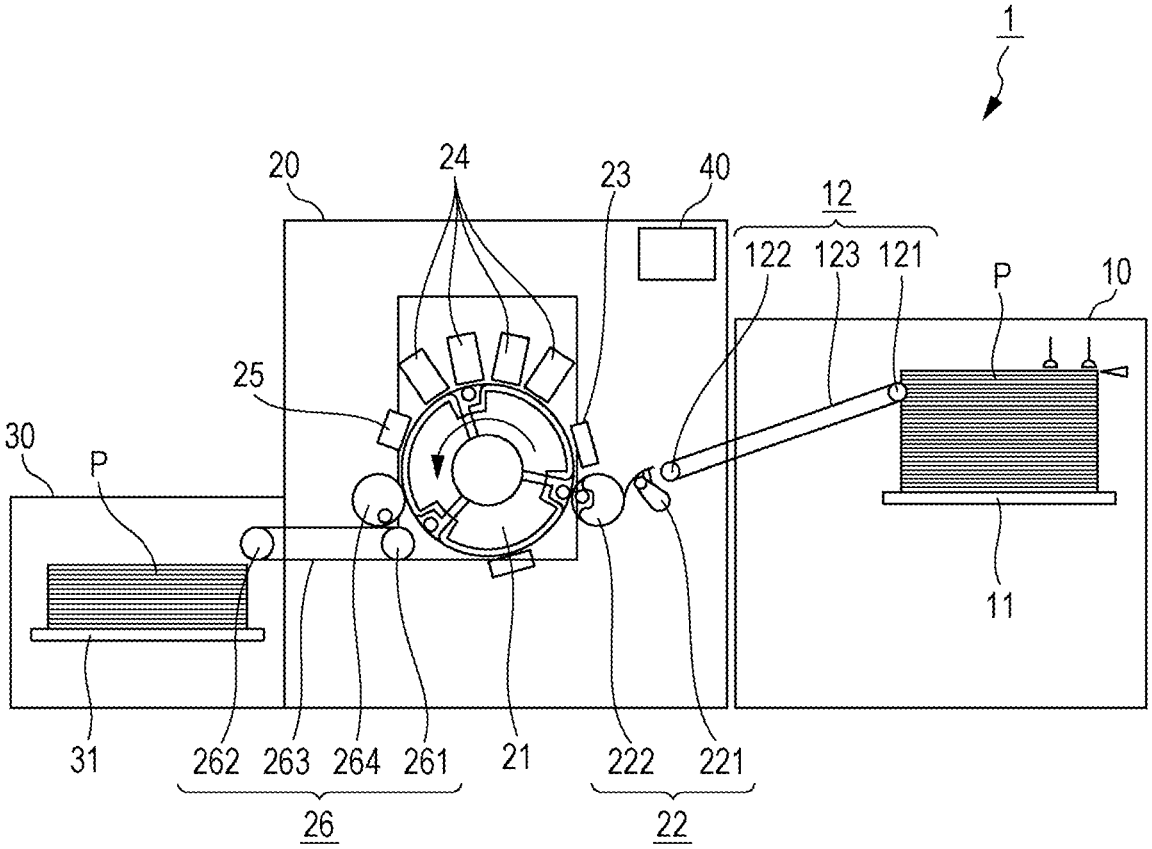
FIG. 1 is a diagram illustrating a main configuration of a printing apparatus.

Hereinafter, one or more embodiments of the present disclosure will be described with reference to the drawings. However, the scope of the disclosure is not limited to the disclosed embodiments. Note that in the following description, components having the same functions and configurations are denoted by the same reference numerals, and the description thereof will be omitted.

[1] Embodiment (1) Printing Apparatus 1

FIG. 1 is a diagram schematically illustrating an overall configuration of a printing apparatus 1 according to an embodiment of the present disclosure. As illustrated in FIG. 1, the printing apparatus 1 includes a sheet feeder 10, an image former 20, a sheet discharger 30, and a controller 40.

(1-1) Sheet Feeder 10

The sheet feeder 10 feeds a recording medium P on which an image is formed to the image former. The sheet feeder 10 includes a sheet feeding tray 11 that holds the recording medium P, and a conveyor 12 that conveys the recording medium P to the image former 20.

The sheet feeding tray 11 is a plate-like member provided so as to be capable of placing one or a plurality of recording media P. The sheet feeding tray 11 is provided so as to move up and down according to an amount of the placed recording medium P, and is held at a position where the uppermost recording medium P is conveyed by the conveyor 12.

The conveyor 12 feeds the uppermost recording medium P among the recording media P placed on the sheet feeding tray 11 onto a belt 123, and the belt 123 of the conveyor 12 is rotated by rollers 121 and 122 to convey the recording medium P on the belt 123.

(1-2) Image Former 20

The image former 20 ejects ink onto the recording medium P fed from the sheet feeder 10 to form an image. The image former 20 includes an image forming drum 21, a transfer unit 22, a sheet heater 23, a head unit 24, an irradiator 25, and a delivery unit 26.

The image forming drum 21 carries the recording medium P along a cylindrical outer circumferential surface, and conveys the recording medium P along with the rotation in a counterclockwise direction in FIG. 1. The conveyance surface of the image forming drum 21 faces the sheet heater 23, the head unit 24, and the irradiator 25.

The transfer unit 22 transfers the recording medium P conveyed by the conveyor 12 to the image forming drum 21. The transfer unit 22 includes a swing arm 221 that carries one end of the recording medium P, a cylindrical transfer drum 222, and picks up the recording medium P on the conveyor 12 with the swing arm 221, guides the recording medium P in a direction along the outer circumferential surface of the image forming drum 21 with the transfer drum 222, and transfers the recording medium P to the image forming drum 21.

The sheet heater 23 heats the recording medium P carried on the image forming drum 21. The sheet heater 23 includes, for example, an infrared heater that generates heat in response to energization. The sheet heater 23 is provided in the vicinity of the outer circumferential surface of the image forming drum 21 and on the upstream side of the head unit 24 in a conveyance direction of the recording medium P. Heat of the sheet heater 23 is controlled by the controller 40 such that the recording medium P carried on the image forming drum 21 and passing through the vicinity of the sheet heater 23 has a predetermined temperature.

The head unit 24 ejects the ink onto the recording medium P carried on the image forming drum 21 to form an image. The head unit 24 is individually provided for each color of yellow (Y), magenta (M), cyan (C), and black (K). In FIG. 1, the head units 24 corresponding to respective colors of Y, M, C, and K are provided in order from the upstream side with respect to the conveyance direction of the recording medium P. A detailed configuration of the head unit 24 will be described later.

After the ink is ejected onto the recording medium P, the irradiator 25 irradiates the recording medium P with an energy ray for curing the ink. The irradiator 25 includes, for example, a fluorescent tube such as a low-pressure mercury lamp. The irradiator 25 is provided in the vicinity of the outer circumferential surface of the image forming drum 21 and on the downstream side of the head unit 24 in the conveyance direction of the recording medium P.

The irradiator 25 may be any unit as long as it emits an energy ray for curing the ink according to a property of the ink, and a mercury lamp, a light source that can be used as a sterilization lamp, a cold cathode tube, an ultraviolet laser light source, a metal halide lamp, a light emitting diode, and the like can be used in addition to the low-pressure mercury lamp.

The delivery unit 26 delivers the recording medium P from the image forming drum 21 to the sheet discharger 30. In the delivery unit 26, the recording medium P carried on the image forming drum 21 is transferred to a belt 263 by a transfer drum 264, and the belt 263 is rotated by rollers 261 and 262 to convey the recording medium P on the belt 263.

(1-3) Sheet Discharger 30

The sheet discharger 30 includes a plate-like sheet discharge tray 31, and stores the recording medium P conveyed from the image former 20.

(1-4) Controller 40

The controller 40 includes a central processing unit (CPU), a read only memory (ROM), and a random access memory (RAM). Various programs stored in the ROM are read and deployed to the RAM, and the program deployed to the RAM is executed by the CPU. According to this, the controller 40 controls operation of each unit of the printing apparatus 1 and controls the overall operation.

(2) Head Unit 24

Details of the head unit 24 will be described below.

Figure 2A:
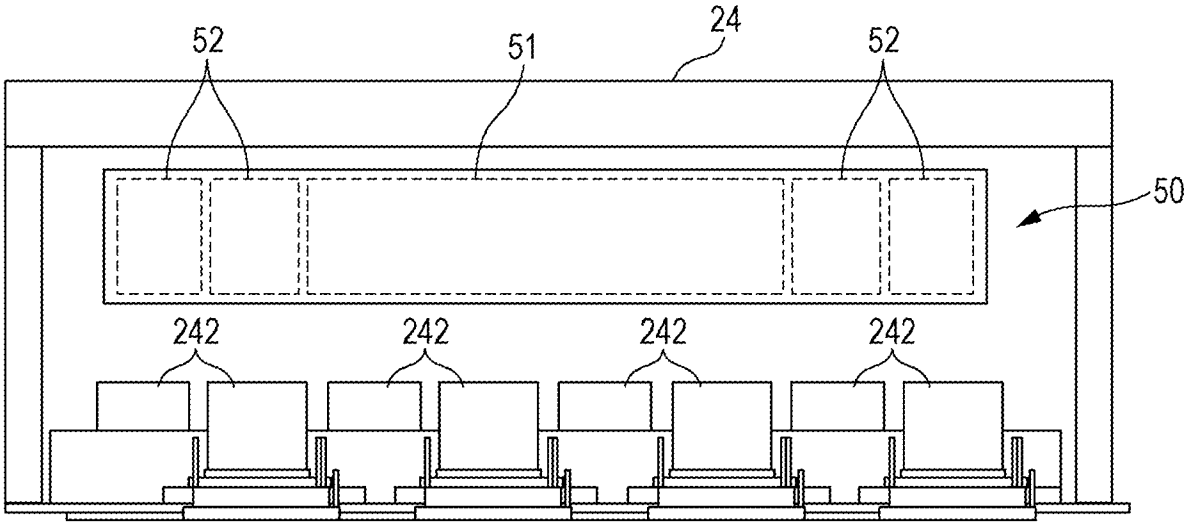
FIG. 2A is a schematic view of an internal configuration of a head unit in a case where the head unit is viewed from a side.
Figure 2B:
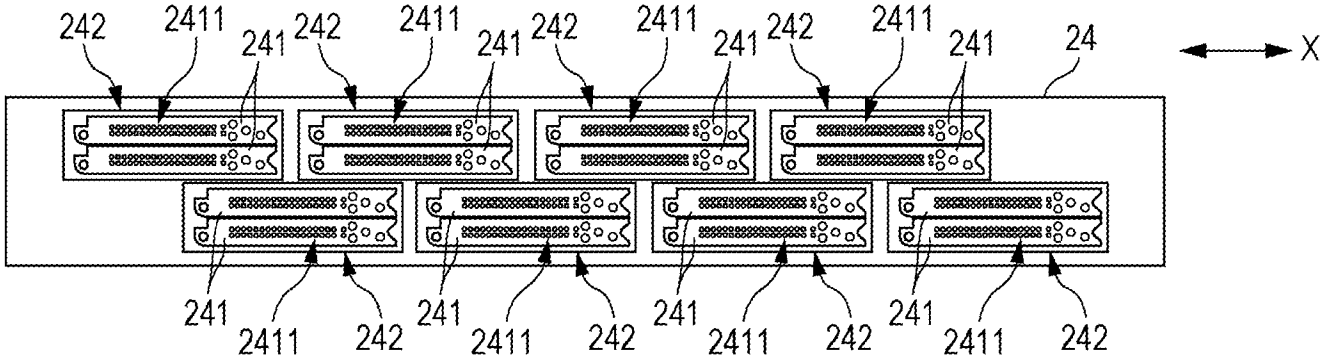
FIG. 2B is a schematic view of the head unit in a case where the head unit is viewed from a recording medium side.

FIG. 2A is a schematic view of an internal configuration of the head unit 24 in a case where the head unit 24 is viewed from a side. FIG. 2B is a schematic view of the head unit 24 in a case where the head unit 24 is viewed from the recording medium P carried on the image forming drum 21.

The head unit 24 is provided with a length (width) that covers the entire recording medium P in a direction (width direction: arrow X direction) perpendicular to the conveyance direction of the recording medium P.

The head unit 24 includes a plurality of inkjet heads 241. In FIG. 2B, one head unit 24 is provided with 16 inkjet heads 241. A set of two inkjet heads 241 of 16 inkjet heads 241 forms eight ink head modules 242.

Each of the inkjet heads 241 includes a plurality of nozzles 2411. The inkjet head 241 ejects the ink from a plurality of the nozzles 2411 to form an image on the recording medium P. Therefore, the inkjet head 241 is provided such that a plurality of the nozzles 2411 are exposed to the lower surface side of the head unit 24 so as to face the recording medium P carried on the image forming drum 21.

The head unit 24 includes an ink tank 50 that stores ink to be supplied to the inkjet head 241 and an ink heating device 60 that heats the ink.

(2-1) Ink Tank 50

Figure 3:
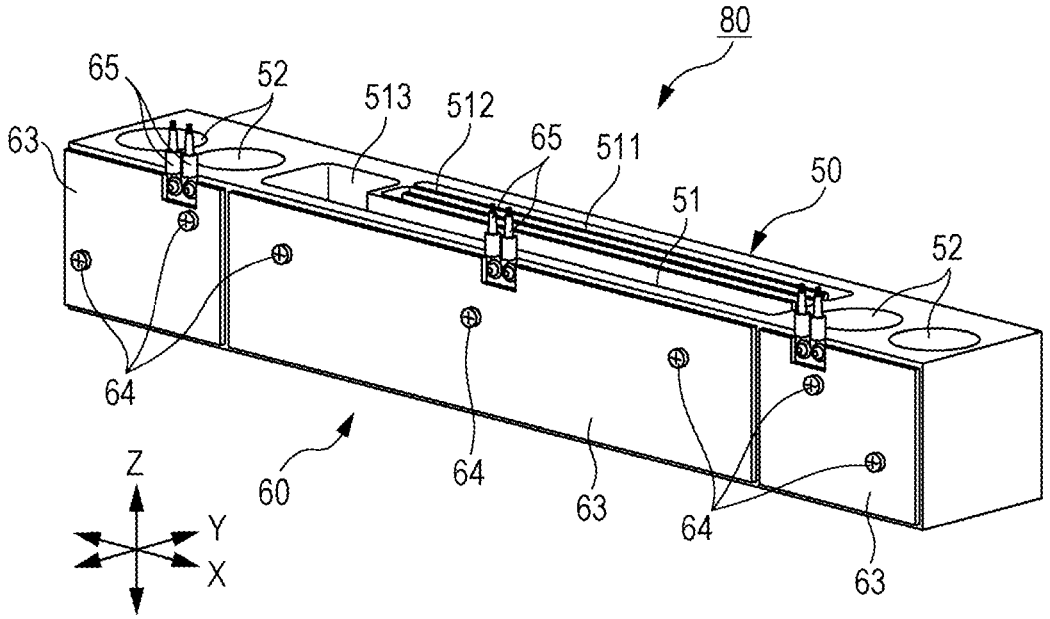
FIG. 3 is a schematic perspective view of an ink tank and an ink heating device.
Figure 4:
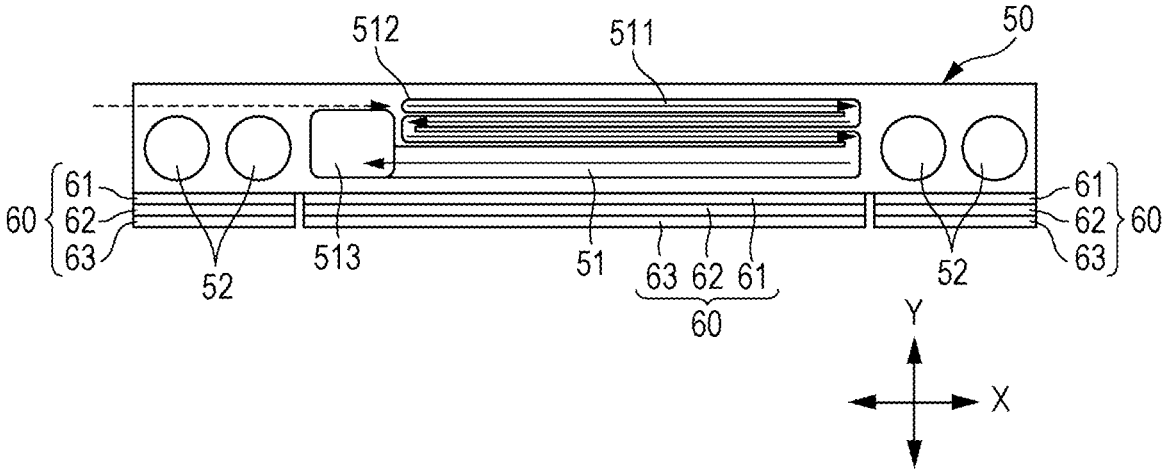
FIG. 4 is a schematic plan view of the ink tank.
Figure 5:
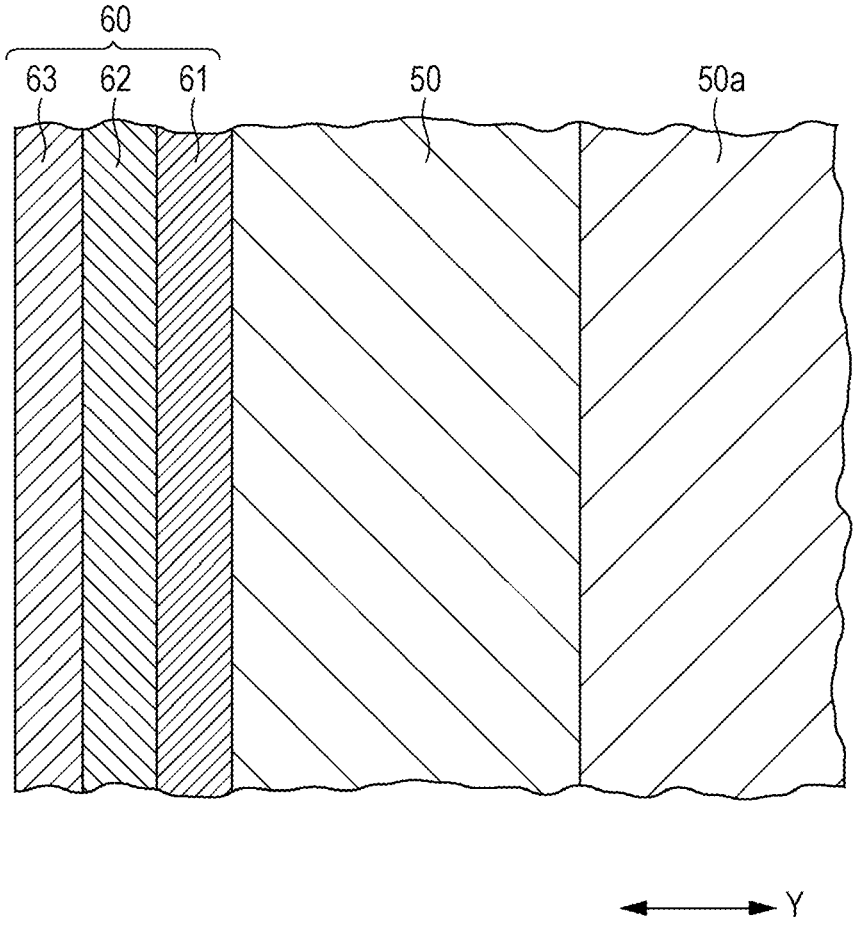
FIG. 5 is a cross-sectional view illustrating a state after the ink heating device is attached to the ink tank.

FIG. 3 is a schematic perspective view of the ink tank 50 and the ink heating device 60. FIG. 4 is a schematic plan view of the ink tank 50. FIG. 5 is a schematic cross-sectional view of the ink tank 50 to which the ink heating device 60 is attached, the cross-sectional view being taken along a plane perpendicular to an X direction of FIG. 3.

Note that a direction perpendicular to the conveyance direction of the recording medium P is an X direction, a conveyance direction of the recording medium P is a Y direction, and an ink ejection direction of the head unit 24 is a Z direction.

The ink tank 50 stores the ink supplied from an ink supplier 70 (refer to FIG. 8), and supplies the stored ink to the inkjet head 241. Furthermore, the ink tank 50 collects and stores the ink that has not been ejected from the inkjet head 241.

The ink tank 50 is formed to be long in the X direction, and is formed by integrally molding a first sub-tank 51 and a plurality of second sub-tanks 52. The first sub-tank 51 and a plurality of the second sub-tanks 52 are disposed in a longitudinal direction of the ink tank 50.

The first sub-tank 51 is recessed at the center of the ink tank 50 in the longitudinal direction, and stores the ink supplied from the ink supplier 70 and the ink collected from the inkjet head 241. The first sub-tank 51 has a flow passage 511 for causing the supplied ink to meander and circulating the supplied ink, and an inflow portion 512, into which the ink supplied from the ink supplier 70 or collected from the inkjet head 241 flows, is formed at one end of the flow passage 511. A storage portion 513 that stores the ink having passed through the flow passage 511 and supplies the ink to the second sub-tank is formed at the other end portion of the flow passage 511. The ink supplied from the inflow portion 512 passes through a flow passage 511, is stored in the storage portion 513, and is sent out to a plurality of the second sub-tanks 52 by a plurality of pumps P1 (refer to FIG. 8).

The second sub-tanks 52 are recessed at opposite ends of the ink tank 50 in the longitudinal direction, and store the ink supplied from the first sub-tank 51. The ink stored in each of the second sub-tanks 52 is supplied to the corresponding inkjet module 242.

Note that in FIGS. 3 and 4, the number of the second sub-tanks is four, but the number of the second sub-tanks is not limited to four, and may be appropriately changed according to the number of the inkjet modules 242.

(2-2) Ink Heating Device 60

The ink heating device 60 is provided so as to cover the entire one side surface of the ink tank 50. The ink heating device 60 includes a planar heating member 61 provided on an outer surface of the ink tank, an elastic member 62 having a heat insulating effect and provided by being stacked on a side of the planar heating member 61 opposite to the ink tank 50, a metal plate (plate-like member) 63 provided by being stacked on a side of the elastic member 62 opposite to the planar heating member 61, a screw 64 for fixing the metal plate 63 to the ink tank 50, a thermistor 65 provided in contact with one side surface of the ink tank 50, and a controller (the controller 40 described above) controlling heat generation of the planar heating member 61.

The planar heating member 61 is in direct surface contact with the ink tank 50, that is, bonded in a state of being thermally bonded to the outer surface of the ink tank 50, and heats ink 50*a* in the ink tank 50 by heating the outer surface of the ink tank 50. A temperature of the planar heating member 61 is controlled by the controller 40 based on the temperature detected by the thermistor 65. Note that a lubricant or an adhesive may or may not be applied between the planar heating member 61 and the ink tank 50.

Figure 6:
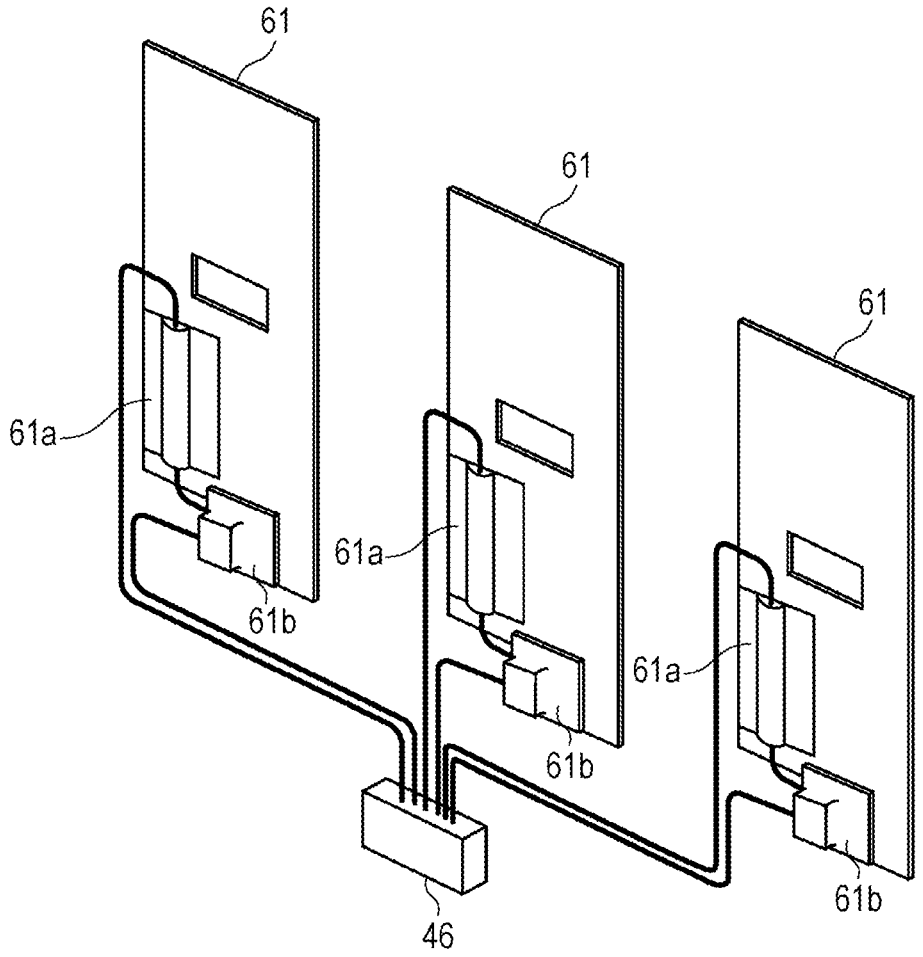
FIG. 6 is a view illustrating a schematic configuration of a planar heating member.

FIG. 6 is a view illustrating a schematic configuration of the planar heating member 61. The planar heating member 61 includes electrodes 61*a* and 61*b*, and is connected to a power supply 45 (refer to FIG. 9) via a switch 46 whose ON/OFF is controlled by the controller 40. The planar heating member 61 generates heat by receiving power from the power supply 45 when the switch 46 is in the ON state.

As the planar heating member 61, for example, a rubber heater in which a heating element is covered with a heat-resistant insulating member in a band shape can be used.

The elastic member 62 is provided between the planar heating member 61 and the metal plate 63. The elastic member 62 is disposed in a state of being pressed by a fixing screw 64 via the metal plate 63 and being elastically deformed in a thickness direction (Y direction), and presses the planar heating member 61 with a substantially constant force in a planar direction by a restoring force of the elastic member 62 to press the planar heating member 61 against the ink tank 50. The elastic member only needs to be a member that has the heat insulating effect, is elastically deformed by pressing the metal plate 63, and can press the planar heating member 61 with the restoring force of the elastic member, for example, a silicone sponge or the like can be used.

The metal plate 63 is provided in contact with the elastic member 62 and forms an outer surface of the ink heating device 60.

As illustrated in FIGS. 3 and 4, the planar heating member 61, the elastic member 62, and the metal plate 63 are provided separately at three locations, that is, a central portion and opposite end portions of the ink tank 50 in the longitudinal direction. Note that the portions of the planar heating member 61 where the electrodes 61*a* and 61*b* exist may also be similarly pressed by the elastic member 62, but the portions of the planar heating member 61 where the electrodes 61*a* and 61*b* exist may not be pressed by the elastic member 62.

The fixing screw 64 is provided to penetrate the planar heating member 61, the elastic member 62, and the metal plate 63, and is screwed into the ink tank 50 to fix the metal plate 63 to the ink tank 50. A through hole having a diameter slightly larger than the diameter of the fixing screw 64 is formed in advance at portions of the planar heating member 61, the elastic member 62, and the metal plate 63 through which the fixing screw 64 passes, and the fixing screw 64 can be easily inserted when the fixing screw 64 is attached.

Figure 7:
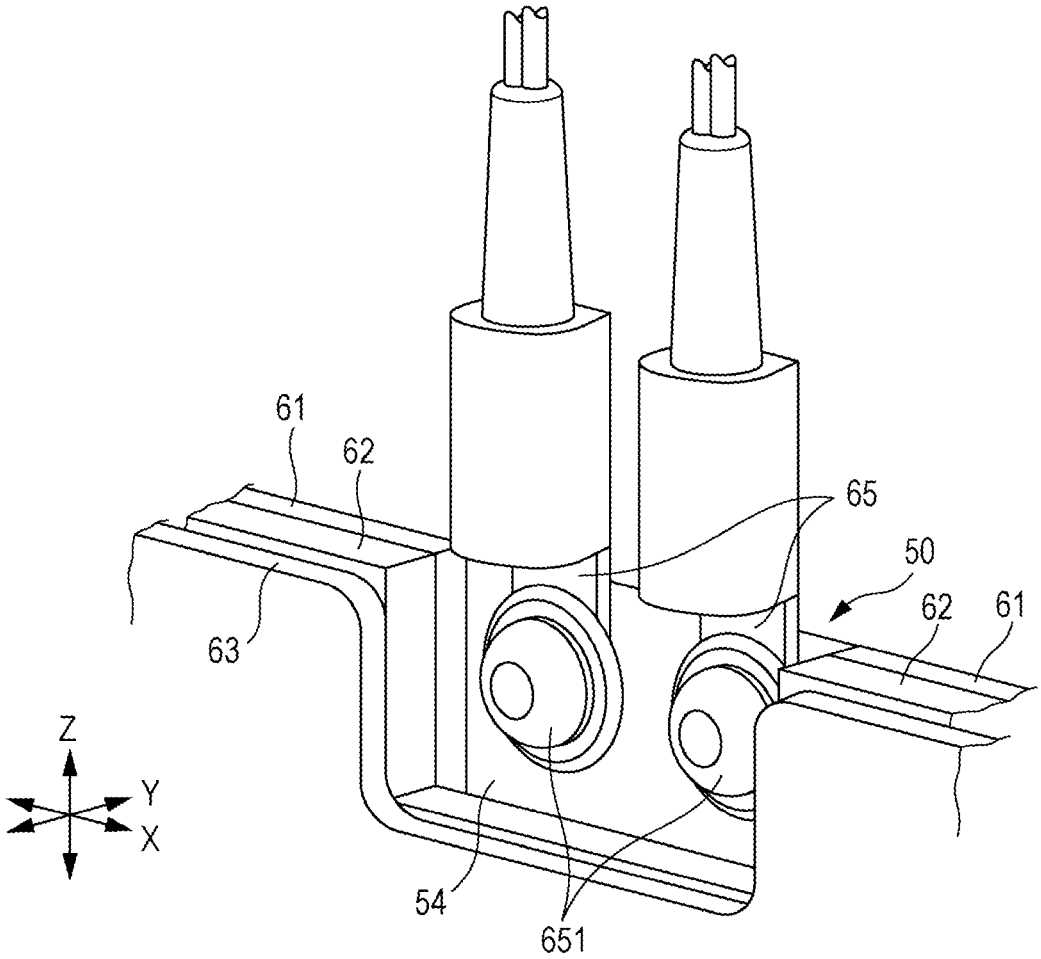
FIG. 7 is a schematic perspective view illustrating an attachment portion of a thermistor.

FIG. 7 is an enlarged view of a portion of FIG. 3 and a schematic perspective view illustrating an attachment portion of the thermistor 65. The thermistor 65 is attached in contact with the ink tank 50, and detects the temperature of the ink tank 50 as a non-heating part. A cutout is formed at edge portions of the planar heating member 61, the elastic member 62, and the metal plate 63 to form an exposure portion 54 in which the ink tank 50 is exposed, and the thermistor 65 is attached to the exposure portion 54 by a screw 651. Note that the thermistor 65 may not be fixed with the screw 651, and may be, for example, formed in a thin film shape and fixed so as to be sandwiched between the ink tank 50 and the planar heating member 61.

(2-3) Ink Ejection Mechanism 300

Figure 8:
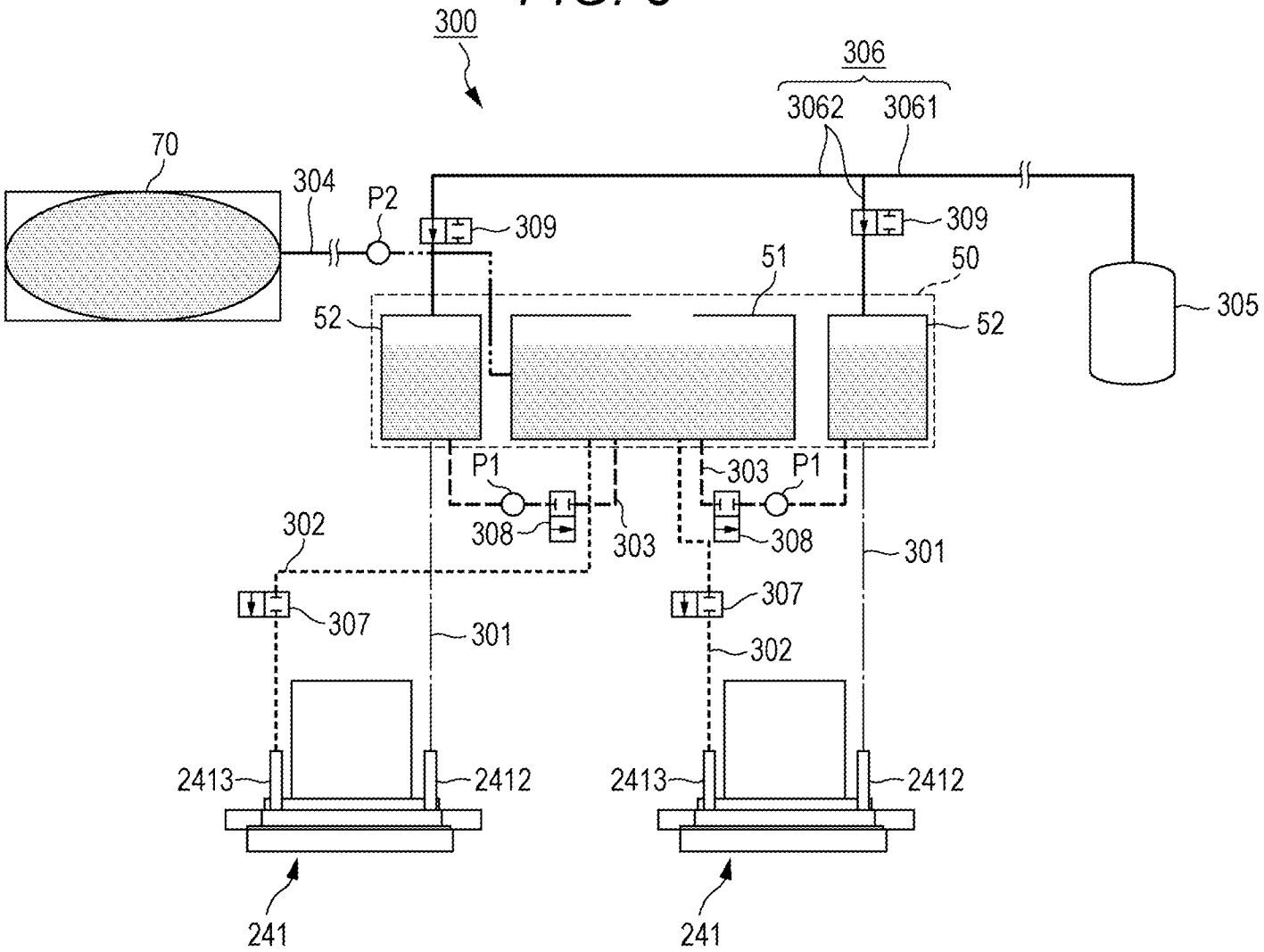
FIG. 8 is a schematic diagram illustrating a main configuration of an ink ejection mechanism in a printing apparatus and connections between units of the ink ejection mechanism.

FIG. 8 is a schematic diagram illustrating a main configuration of the ink ejection mechanism 300 in the printing apparatus 1 and connections between units of the ink ejection mechanism.

The ink ejection mechanism 300 includes the ink supplier 70 that supplies the ink, the ink tank 50 that stores the ink supplied from the ink supplier 70, the inkjet head 241 that ejects the ink supplied from the ink tank 50, a pressure controller 305 that sets a pressure of the nozzles 2411 of the inkjet head 241 to a negative pressure, a passage 304 that connects the ink supplier 70 with the ink tank 50, a passage 303 that connects the first sub-tank 51 with the second sub-tank 52 in the ink tank 50, a supply passage 301 that connects the second sub-tank 52 with the inkjet head 241, a collection passage 302 that connects the inkjet head 241 with the first sub-tank 51, and a ventilation passage 306 that connects the second sub-tank 52 with the pressure controller 305.

Note that in FIG. 8, each passage serving as a passage for ink is indicated by a broken line, but a specific configuration of each passage is a closed passage for an ink flow.

The ink supplier 70 stores the ink circulated through each unit of the ink ejection mechanism 300, and the ink is supplied to the first sub-tank 51 of the ink tank 50.

The first sub-tank 51 stores the ink supplied from the ink supplier 70 and the stored ink is supplied to the second sub-tank 52. The ink supplied to the first sub-tank 51 flows in from the inflow portion 512, is stored in the storage portion 513 through the flow passage 511, and is supplied from the storage portion 513 to the second sub-tank 52.

The non-heated ink at room temperature is supplied from the ink supplier 70 to the first sub-tank 51, but since the supplied ink is supplied to the second sub-tank 52 via the flow passage 511, it takes a certain amount of time to reach the second sub-tank 52. During this period, the room temperature ink supplied to the first sub-tank 51 is sufficiently heated by the ink heating device 60 provided outside the first sub-tank 51. According to this, even in a case where an ink ejection amount is great, the supply of low temperature ink from the first sub-tank 51 to the second sub-tank 52 is suppressed.

The second sub-tank 52 stores the ink supplied from the first sub-tank 51 and the stored ink is supplied to the inkjet head 241. According to this, the ink stored in the second sub-tank 52 is sufficiently heated, and the occurrence of ejection failure due to the low-temperature ink supplied to the inkjet head 241 is suppressed.

The pressure controller 305 is connected to the second sub-tank 52 and adjusts pressure in the second sub-tank 52 under the control of the controller 40. According to this, the pressure controller 305 sets the pressure of the nozzles 2411 of the inkjet head 241 to a negative pressure state via the second sub-tank 52 and the supply passage 301. This prevents the ink from leaking from the nozzles when image formation and various types of maintenance are not performed.

Each of the supply passage 301, the collection passage 302, and the passages 303 and 304 is a tubular member through which the ink passes, and is made of, for example, a resin or the like or a member having good heat conductivity.

The passage 304 connects the first sub-tank 51 with the ink supplier 70, and a pump P2 is provided in the passage 304. The pump P2 operates under the control of the controller 40, and supplies the ink from the ink supplier 70 to the first sub-tank 51. As the pump P2, for example, a positive displacement pump such as a diaphragm pump, a tube pump, or the like is used.

The passage 303 connects the second sub-tank 52 with the first sub-tank 51, and a pump P1 is provided in the passage 303. The pump P1 operates under the control of the controller 40, and supplies the ink from the first sub-tank 51 to the second sub-tank 52. As the pump P1, for example, a positive displacement pump such as a diaphragm pump, a tube pump, or the like is used.

The supply passage 301 connects an inlet 2412 of the inkjet head 241 with the second sub-tank 52.

The collection passage 302 connects an outlet 2413 of the inkjet head 241 with the first sub-tank 51.

The ventilation passage 306 connects the second sub-tank 52 with the pressure controller 305. The ventilation passage 306 is a tubular member through which air passes, and is made of, for example, a resin or the like. The ventilation passage 306 has a structure in which one common ventilation passage 3061 connected to the pressure controller 305 is branched into a plurality of branch ventilation passages 3062 respectively connected to a plurality of the second sub-tanks 52.

Furthermore, electromagnetic valves 307, 308, and 309 are provided in the collection passage 302, the passage 303, and the branch ventilation passage 3062, respectively. Each of the electromagnetic valves 307 to 309 opens and closes the ink flow passage or ventilation passage having the electromagnetic valves provided therein under the control of the controller 40. That is, the electromagnetic valve 307 provided in the collection passage 302 switches opening and closing of the collection passage 302. The electromagnetic valve 308 provided between the first sub-tank 51 and the pump P1 in the passage 303 switches opening and closing of connection between the first sub-tank 51 and the pump P1. The electromagnetic valve 309 provided in the branch ventilation passage 3062 switches opening and closing of connection between the second sub-tank 52 and the pressure controller 305.

Note that the second sub-tank 52 is a tank-like container hermetically sealed except for the above-described various connection portions. That is, the pressure in the second sub-tank 52 changes depending on the degree of negative pressure applied by the pressure controller 305, presence or absence of the ink supply from the first sub-tank 51, and the like. For example, when the ink is supplied from the first sub-tank 51 in a state where the electromagnetic valve 309 is closed and the negative pressure applied by the pressure controller 305 is lost, the pressure in the second sub-tank 52 increases as an amount of the ink in the second sub-tank 52 increases.

On the other hand, the first sub-tank 51 is a container opened to the outside, and is kept at substantially atmospheric pressure regardless of the increase or decrease in the amount of the ink.

(2-4) Ink Heating Control

Figure 9:
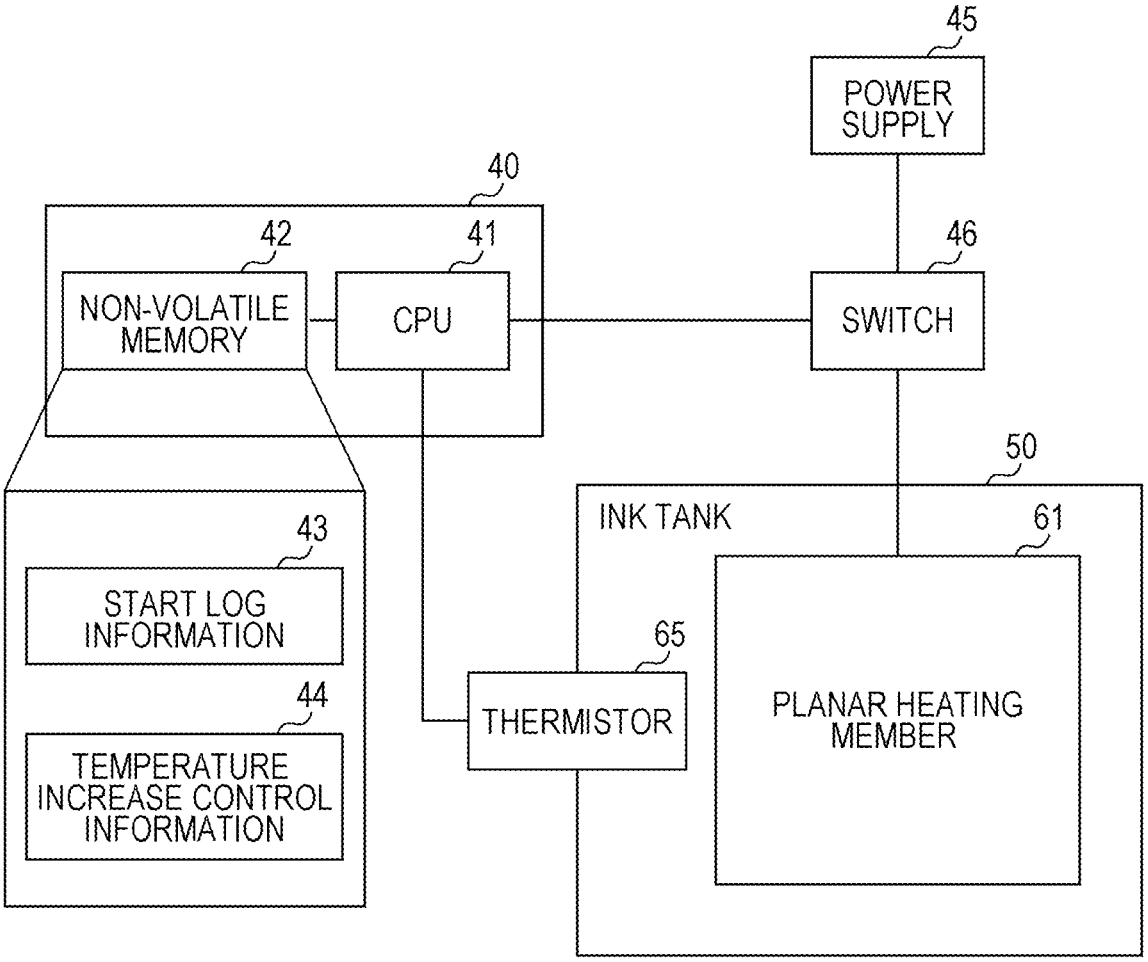
FIG. 9 is a block diagram illustrating a control configuration of ink heating.

FIG. 9 is a block diagram illustrating a control configuration of ink heating.

As described above, the planar heating member 61 is connected to the power supply 45 via the switch 46. ON/OFF of the switch 46 is controlled by a CPU 41 of the controller 40. The CPU 41 of the controller 40 is sequentially notified of the temperature detected by the thermistor 65. A target temperature is set in the planar heating member 61, the CPU 41 sets the switch 46 to an ON state in a case where the temperature notified from the thermistor 65 is lower than the target temperature, and sets the switch 46 to an OFF state in a case where the temperature is equal to or higher than the target temperature. According to this, the temperature of the ink stored in the ink tank 50 is maintained at the target temperature.

In the elastic member 62 described above, when the deterioration progresses and the elastic force of the elastic member is lost, the force pressing the heating member against the ink tank side is weakened, a gap (air layer) is formed between the heating member and the ink tank, the air layer becomes a heat insulating layer, and thus heat may not be easily transferred to the ink tank. As a deterioration factor of the elastic member 62, heating in a state of containing moisture, in particular, a rapid temperature increase is estimated.

Therefore, in a case the ink heating device 60 determines whether or not the elastic member 62 contains the predetermined amount or more of moisture, and it is determined that the elastic member 62 contains a predetermined amount or more of moisture, the ink heating device 60 controls overheating of the ink in a stepwise manner so as not to cause a rapid temperature increase. Specifically, preheating control for increasing the temperature of the ink to a preheating temperature is performed before executing a main heating control for increasing the temperature of the ink to a main heating temperature suitable for supplying the ink to the inkjet head 241.

Here, with respect to the moisture contained in the elastic member 62, heating control for supplying the ink by the inkjet method is performed when the printing apparatus 1 is in operation, the elastic member 62 is also maintained at a high temperature, and thus the moisture is vaporized. Therefore, it is unlikely that the elastic member 62 contains a large amount of moisture. On the other hand, at the time of stopping the printing apparatus 1, although depending on the surrounding humidity, the elastic member 62 has a temperature of about room temperature, an amount of moisture to be vaporized is decreased, and a large amount of moisture is contained in the elastic member 62 according to the stop time.

Therefore, the ink heating device 60 of the present disclosure determines whether or not the elastic member 62 contains a predetermined amount or more of moisture based on the stop time of the printing apparatus 1. That is, when the stop time of the printing apparatus 1 is longer than a predetermined time, the preheating control is performed before the main heating control.

Furthermore, in the preheating control, the ink heating device 60 performs the preheating in a stepwise manner such that the longer the stop time of the printing apparatus 1, the lower an average temperature increase rate until reaching the target value of the preheating temperature from the room temperature.

Hereinafter, the preheating control executed by the ink heating device 60 will be described in detail.

The controller 40 executes the preheating control by using start log information 43 and temperature increase control information 44 stored in a non-volatile memory 42.

FIG. 10 is a diagram illustrating an example of the start log information 43. The start log information 43 is log information in which the start time and the stop time of the printing apparatus 1 are recorded. When warming up at the time of starting the printing apparatus 1, the controller 40 calculates the stop time of the printing apparatus 1 from a difference between the latest start time from the current time and the latest stop time from the current time.

FIG. 11 is a diagram illustrating an example of the temperature increase control information 44. The temperature increase control information 44 is set information in which the number of heating stages in the preheating control, and the target temperature and maintaining time in each heating are set.

In the example of FIG. 11, in a case where the stop time of the printing apparatus is zero days (less than 24 hours), the number of heating stages in the preheating control is zero, that is, the main heating control is executed from the beginning without executing the preheating control.

Furthermore, in a case where the stop time of the printing apparatus is one to two days (24 hours or more and less than 72 hours), the number of heating stages is two, the main heating control is executed after a first-stage heating and a second-stage heating are executed as the preheating control. In the first-stage heating, the target temperature is set to 35° C., and the temperature of the ink is maintained at the target temperature for 10 seconds after reaching the target temperature. In the second-stage heating, the target temperature is set to 50° C., and the temperature of the ink is maintained at the target temperature for 10 seconds after reaching the target temperature.

In a case where the stop time of the printing apparatus is three to ten days (72 hours or more and less than 264 hours), the number of heating stages is three, the main heating control is executed after the first-stage heating, the second-stage heating, and a third-stage heating are executed as the preheating control. In the first-stage heating, the target temperature of 30° C. is maintained for 10 seconds. In the second-stage heating, the target temperature of 40° C. is maintained for 10 seconds. In the third-stage heating, the target temperature of 50° C. is maintained for 10 seconds.

In a case where the stop time of the printing apparatus is eleven to twenty days (264 hours or more and less than 504 hours), the number of heating stages is three, the main heating control is executed after the first-stage heating, the second-stage heating, and the third-stage heating are executed as the preheating control. In the first-stage heating, the target temperature of 30° C. is maintained for 20 seconds. In the second-stage heating, the target temperature of 40° C. is maintained for 20 seconds. In the third-stage heating, the target temperature of 50° C. is maintained for 20 seconds.

In a case where the stop time of the printing apparatus is twenty one days or more (504 hours or more), the number of heating stages is four, the main heating control is executed after the first-stage heating, the second-stage heating, the third-stage heating, and a fourth-stage heating are executed as the preheating control. In the first-stage heating, the target temperature of 30° C. is maintained for 30 seconds. In the second-stage heating, the target temperature of 40° C. is maintained for 20 seconds. In the third-stage heating, the target temperature of 45° C. is maintained for 20 seconds. In the fourth-stage heating, the target temperature of 50° C. is maintained for 10 seconds.

The ink heating device 60 controls overheating caused by the planar heating member 61 in accordance with the temperature increase control information 44.

Figure 12:
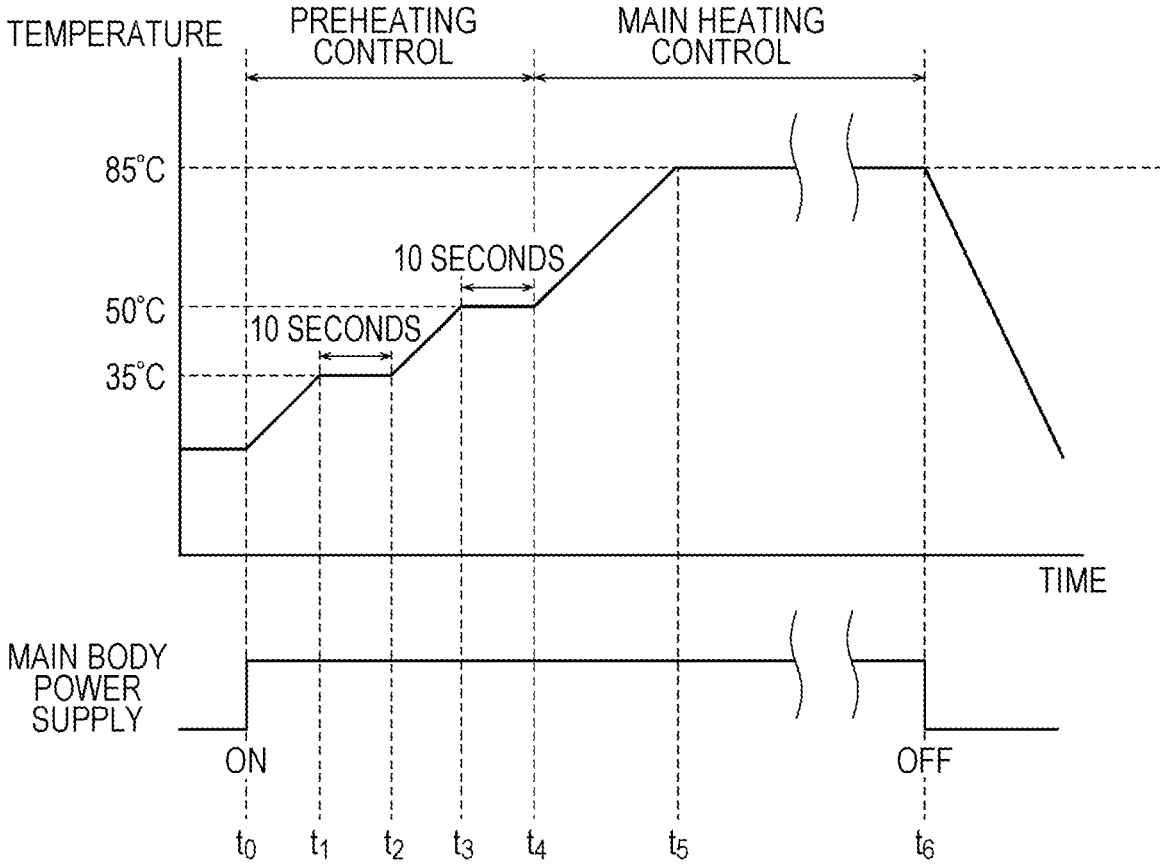
FIG. 12 is a graph illustrating a transition of a temperature detected by a thermistor and a transition of ON/OFF of a main body power supply of a printing apparatus.

FIG. 12 is a graph illustrating a transition of the temperature detected by the thermistor 65 and a transition of ON/OFF of the main body power supply of the printing apparatus 1 in a case where the stop time of the printing apparatus 1 is one to two days. At time t0, the main body power supply is switched from OFF to ON, and the first-stage heating of the preheating control is started. At time t1, the temperature detected by the thermistor 65 reaches the target value of 35° C. in the first-stage heating, and the control is performed to maintain the temperature detected by the thermistor 65 at 35° C. for 10 seconds from time t1 to time t2. When the second-stage heating of the preheating control is started at time t2, and the temperature detected by the thermistor 65 reaches the target value of 50° C. in the second-stage heating at time t3, the control is performed to maintain the temperature detected by the thermistor 65 at 50° C. for 10 seconds from time t3 to time t4. When the main heating control is started at time t4, and the temperature detected by the thermistor 65 reaches the target value of 85° C. in the main heating at time t5, the temperature detected by the thermistor 65 is maintained at 85° C. until the main body power supply is OFF.

Figure 13:
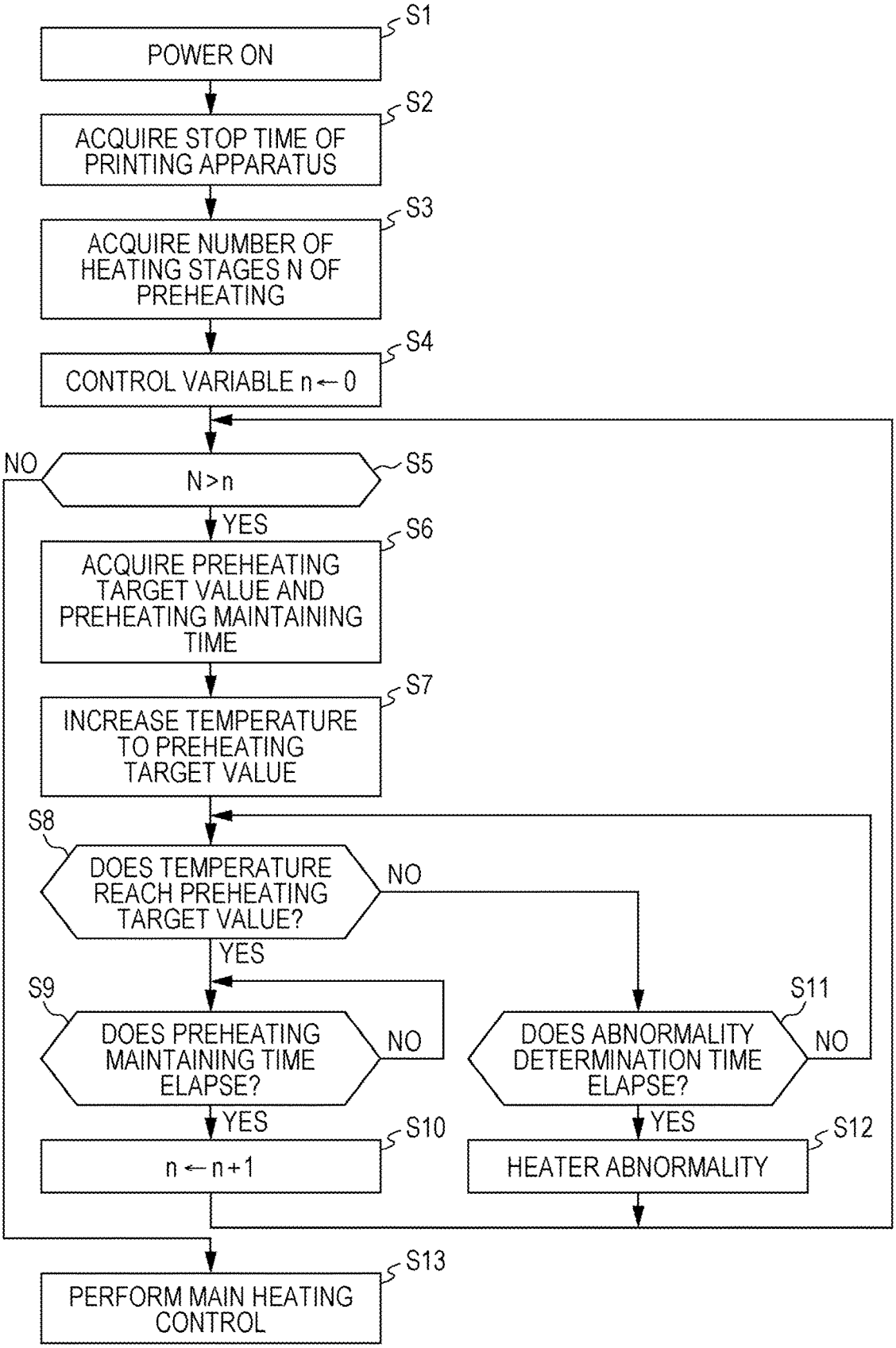
FIG. 13 is a flowchart illustrating an ink heating control at the time of warming up.

FIG. 13 is a flowchart of the ink heating control executed by the controller 40 at the time of warming up of the printing apparatus 1 (at the time of power ON).

When detecting the power ON of the printing apparatus 1 (Step S1), the controller 40 calculates the stop time of the printing apparatus 1 from the latest start time and the stop time with reference to the start log information 43 (Step S2).

The controller 40 determines the number of heating stages N corresponding to the stop time of the printing apparatus 1 calculated in Step 2 with reference to the temperature increase control information 44 (Step S3).

The controller 40 initializes a control variable n (Step S4), performs the preheating control (Step S6 to Step S9) while the number of heating stages N>the control variable n is satisfied (Step S5: YES), and performs the main heating control (Step S13) in a case where the number of heating stages N>the control variable n is not satisfied (Step S5: NO).

In the preheating control, the controller 40 sets a preheating target value and a preheating maintaining time according to the stop time of the printing apparatus 1 calculated in Step S2 and the control variable n with reference to the temperature increase control information 44 (Step S6). In the present disclosure, n is a variable indicating the number of heating stages being performed in the preheating control, and the target temperature and the maintaining time of the (n+1)th stage heating in the temperature increase control information 44 are acquired as the preheating target value and the preheating maintaining time. For example, in a case where the stop time of the printing apparatus 1 is 48 hours and n=1, the target temperature of 50° C. and the maintaining time of 10 seconds in the second-stage heating with the record having the stop time of one to two days are set as the preheating target value and the preheating maintaining time.

The controller 40 turns on the switch 46 to start the heat generation of the planar heating member 61, and starts the temperature increase of the ink in the ink tank 50 to the set preheating target value (Step S7).

The controller 40 determines whether or not the temperature of the ink has increased to the preheating target value with reference to the temperature notified from the thermistor 65 (Step S8).

In a case where the temperature of the ink has not increased to the preheating target value (Step S8: NO), it is determined whether or not the time from the start of heat generation by the planar heating member 61 in Step S7 exceeds a predetermined abnormality determination time (Step S11).

In a case where the time from the start of the heat generation by the planar heating member 61 in Step S7 exceeds a predetermined abnormality determination time (Step S11: YES), the controller 40 determines that heater abnormality (abnormality in which the planar heating member 61 cannot normally perform heating) has occurred, and takes a measure against the heater abnormality (for example, the preheating control is stopped, or a display indicating that a heater abnormality has occurred is performed on a display device provided in the printing apparatus 1) (Step S12).

In a case where the time from the start of heat generation by the planar heating member 61 in Step S7 does not exceeds a predetermined abnormality determination time (Step S11: NO), the processing returns to Step S8 after waiting for a predetermined time, and determination whether or not the temperature of the ink is increased to the preheating target value is performed again.

In a case where the temperature of the ink has increased to the preheating target value (Step S8: YES), the control is performed to maintain the temperature of the ink at the preheating target value until the elapsed time after the temperature of the ink reaches the preheating target value exceeds the preheating maintaining time (Step S9: NO).

Note that the control for maintaining the temperature of the ink at the preheating target value is performed by, for example, feedback control for monitoring the temperature of the ink notified from the thermistor 65, turning off the switch in a case where the temperature is equal to or higher than the preheating target value, and turning on the switch in a case where the temperature is lower than the preheating target value.

When the elapsed time after the temperature of the ink reaches the preheating target value exceeds the preheating maintaining time, the (n+1)th stage heating control in the preheating control is ended, the control variable n is incremented (Step S10), and the processing returns to Step S5.

As described above, by switching the number of heating stages of the preheating control according to the magnitude of the stop time of the printing apparatus 1 before the main heating control, the ink heating device 60 does not cause a rapid temperature increase in a state of containing moisture which causes deterioration of the elastic member 62 regardless of whether the stop time is long or short, and thus the deterioration of the elastic member 62 can be suppressed.

[2] Modified Example

Although the present disclosure has been described based on the embodiment, it is needless to say that the present disclosure is not limited to the above-described embodiment, and the following modified example can be implemented.

(1) In the embodiment described above, an increase in the number of heating stages and prolongation of the preheating maintaining time are both performed when the stop time of the printing apparatus 1 becomes longer, but one or both of the increase in the number of heating stages and the prolongation of the preheating maintaining time may not be performed as long as an average temperature change rate up to the main heating temperature can be reduced.

Furthermore, a function of detecting the humidity around the printing apparatus 1 (or the ink tank 50) by using a sensor or the like may be provided, and as long as the humidity during the stop period of the printing apparatus 1 or the humidity at the time of starting of the printing apparatus 1 is equal to or greater than a predetermined threshold (for example, 80% RH indicating high humidity), the control may be performed to increase the number of heating stages in the preheating more than that at the time of low humidity and normal humidity.

(2) In the embodiment described above, the printing apparatus 1 has been described as a one-pass line-head type inkjet printing apparatus configured by arranging a plurality of the inkjet heads 241 in the head unit 24 provided with a width covering the entire recording medium P in the width direction of the recording medium P. However, a multi-pass serial head type inkjet printing apparatus may be used.

(3) In the embodiment described above, the temperature of the ink is indirectly detected by the thermistor 65 detecting the temperature of the ink tank 50, but the method of temperature detection used for heating control is not limited thereto. For example, the temperature detection may be performed using a temperature measurement resistor whose electric resistivity changes in proportion to the temperature, or the temperature detection may be performed using a non-contact thermometer that measures an energy amount of an infrared ray emitted from the object surface. Furthermore, the temperature of the ink may be indirectly detected from the temperature of the ink tank 50 and the elastic member 62, or the temperature of the ink may be directly measured.

The present disclosure can be used for the inkjet printing apparatus.

Although embodiments of the present disclosure have been described and illustrated in detail, the disclosed embodiments are made for purposes of illustration and example only and not limitation. The scope of the present disclosure should be interpreted by terms of the appended claims.

As used herein, the words "can" and "may" are used in a permissive (i.e., meaning having the potential to), rather than mandatory sense (i.e., meaning must). The words "include," "includes," "including," and the like mean including, but not limited to. Similarly, the singular form of "a" and "the" include plural references unless the context clearly dictates otherwise. And the term "number" shall mean one or an integer greater than one (i.e., a plurality).

What is claimed is:

1. An ink heating device incorporated in an inkjet printing apparatus, the ink heating device comprising:

a planar heating member that is bonded in a state where one surface of the planar heating member is thermally bonded to an outer surface of an ink tank storing ink;

an elastic member, having a heat insulation property, (i) is provided on the other surface of the planar heating member and (ii) presses the planar heating member against the ink tank; and a hardware processor that performs heating control on the planar heating member in a stepwise manner according to a stop time of a main body of the printing apparatus at a time of starting the main body of the printing apparatus.

2. The ink heating device according to claim 1, further comprising:

a temperature detector that detects a temperature of a heating part heated by the planar heating member, wherein, in a case where the stop time exceeds a predetermined threshold, the hardware processor executes:

preheating control for increasing a temperature of the heating part to a preheating target value and maintaining the temperature; and main heating control for increasing the temperature of the heating part from the preheating target value to main heating target value after the preheating control.

3. The ink heating device according to claim 2, wherein, in the preheating control, a maintaining time for maintaining the preheating target value and the heating part at the preheating target value is set in a stepwise manner according to the stop time.

4. The ink heating device according to claim 3, wherein, in the preheating control, the preheating target value and the maintaining time are set such that an average temperature change of the heating part becomes gentler as the stop time is longer.

5. The ink heating device according to claim 3, further comprising:

a non-volatile storage that stores in advance the preheating target value and the maintaining time in the preheating control.

6. The ink heating device according to claim 3, further comprising:

an acquisitor that acquires the preheating target value and the maintaining time in the preheating control from an external device.

7. The ink heating device according to claim 2, wherein a plurality of target values including a first target value and a second target value higher than the first target value are set as the preheating target value, and wherein the preheating control includes:

a first-stage heating control of increasing the temperature of the heating part to the first target value and maintaining the temperature; and a second-stage heating control of increasing the temperature of the heating part from the first target value to the second target value and maintaining the temperature after the first-stage heating control.

8. The ink heating device according to claim 7, wherein an amount of heating stages in the preheating control is increased as the stop time is longer.

9. The ink heating device according to claim 2, wherein the preheating target value is set within a range of a heat-resistant temperature of the elastic member.

10. The ink heating device according to claim 2, wherein the heating part includes at least one of ink stored in the ink tank, the ink tank, or the elastic member.

11. An inkjet printing apparatus comprising the ink heating device according to claim 1.

* * * * *